US008757076B2

(12) United States Patent
Haller et al.

(10) Patent No.: US 8,757,076 B2
(45) Date of Patent: Jun. 24, 2014

(54) PORTABLE SAIL FOR PADDLE-TYPE VESSELS

(75) Inventors: Clayton F. Haller, Benicia, CA (US); Charles P. Hall, Bainbridge, WA (US); Ryan Pugh, Concord, CA (US)

(73) Assignee: Advanced Elements, Inc., Benicia, CA (US)

( * ) Notice: Subject to any disclaimer, the term of this patent is extended or adjusted under 35 U.S.C. 154(b) by 124 days.

(21) Appl. No.: 13/073,784

(22) Filed: Mar. 28, 2011

(65) Prior Publication Data

US 2012/0247379 A1 Oct. 4, 2012

(51) Int. Cl.
*B63B 35/00* (2006.01)

(52) U.S. Cl.
USPC ..... 114/39.22

(58) Field of Classification Search
USPC ..... 114/102.1, 102.11, 102.12, 102.13, 114/102.14, 102.15, 102.16, 8, 102.19, 114/102.21, 102.22, 102.29, 102.31, 104, 114/107, 108, 109, 111, 113, 114, 115, 114/39.11, 39.21, 39.22, 39.29, 39.31
See application file for complete search history.

(56) References Cited

U.S. PATENT DOCUMENTS

| | | | | |
|---|---|---|---|---|
| 1,859,178 | A | 5/1932 | Sprinkle | |
| RE29,279 | E * | 6/1977 | Fretwell, Jr. | 114/104 |
| 4,082,049 | A | 4/1978 | Nicol | |
| 4,958,582 | A * | 9/1990 | Vermillion et al. | 114/39.29 |
| 5,289,792 | A | 3/1994 | Forrest et al. | |
| 5,377,607 | A | 1/1995 | Ross | |
| 5,642,683 | A * | 7/1997 | Bedford | 114/102.1 |
| 6,390,013 | B1 | 5/2002 | Cornell | |
| 6,457,430 | B1 | 10/2002 | Drabkin | |
| 6,615,758 | B2 | 9/2003 | Blad | |
| 6,655,314 | B2 | 12/2003 | Housely et al. | |
| 6,776,115 | B1 | 8/2004 | De Meo | |
| 6,807,919 | B1 | 10/2004 | Thomsen | |
| 7,726,694 | B2 * | 6/2010 | Guillot | 280/810 |
| 7,752,987 | B2 * | 7/2010 | Wiltz | 114/102.11 |
| 2009/0139438 | A1 * | 6/2009 | Wiltz | 114/102.12 |

* cited by examiner

*Primary Examiner* — Daniel V Venne
(74) *Attorney, Agent, or Firm* — Lowe Graham Jones PLLC

(57) ABSTRACT

A removable sail for a paddle-style boat, such as a kayak preferably takes the form of a fast deploying down-wind sail attachable to a deck of the kayak. The sail includes a curved, but non-circular shaped flexible material coupled to a collapsible, continuous frame member, for example the frame member may be sewn into a channel made by the material. When mounted to the deck of the boat, the sail may be arranged in a deployed or a stowed configuration, the latter being deployable on the fly in that the sail can be quickly sprung into the deployable configuration. The non-circular shape of the sail cooperates with a hull shape of the boat while providing a sufficient surface area for capturing wind energy. The sail may also include a transparent region that helps prevent excessive amounts of spray from striking the paddler and yet still provides an adequate viewing range.

16 Claims, 6 Drawing Sheets

PORTABLE SAIL FOR PADDLE-TYPE VESSELS

FIELD OF THE INVENTION

This invention relates generally to a portable sail for paddle-type vessels such as kayaks and canoes, and more specifically to a portable, rapidly deployable sail that may be mounted to a hybrid inflatable kayak.

BACKGROUND OF THE INVENTION

The paddle-type boats referenced herein are generally small, human-powered boats that are traditionally rowed over a body of water and such boats may include, but are not limited to kayaks, canoes, and rafts. By way of example, one type of paddle-type boat may take the form of a kayak with a covered deck, and one or more cockpits, each seating one paddler who strokes a double-bladed paddle. The cockpit is generally covered by a spraydeck that keeps the inside of the boat and the paddler's lower body dry. The spraydeck or similar waterproof covering attaches securely to the edges of the cockpit, preventing the entry of water from waves or spray.

An inflatable kayak, also known as a ducky, can usually be transported by hand using a carry bag. An outer skin, cover or shell of a conventional inflatable kayak may be made from hypalon (a kind of neoprene), a polyvinyl chloride fabric, or a polyurethane coated cloth. They may have a nylon covering with bladders inflatable within the covering. They can be inflated with foot, hand, or electric pumps and may include multiple air compartments for increased safety. Inflatable kayaks also typically include a top covering having a spraydeck.

For kayaks and canoes in particular, especially since they are designed to be paddled over longer distances and across large bodies of water, having a sail to propel the kayak or canoe may be advantageous and help save valuable energy that would otherwise be expended through paddling. Conventional sails for these types of vessels are typically supported with a static mounting that does not allow for quick dousing or de-powering. The ease and speed of taking down the sail is paramount to safety while sailing in a small vessel like a canoe or kayak. If an increase in wind speed or undesired change in wind direction occurs, the rigidly attached sail may be over powered and upset, which may result in a capsizing event. The rigging and mounts for some conventional sails may also add unwanted weight or rigid elements that should be avoided with an inflatable kayak.

Some conventional sails currently available for kayaks and canoes include the SPIRIT SAILS® sailrigs made by Downwind, LLC, and which takes the form of a V-shaped sail firmly connected to the boat. The sail remains up and deployed without the ability to instantly douse or take it down in the event of a sudden increase in wind speed.

The QUIVERSAIL® sail made by QuiverSail, Inc. is also a V-shaped sail with stiffening members that can be either fastened to the deck of a kayak or canoe or hand held. The ZEPHYR™ sail has a kite-like shape with no stiffeners and is hand-flown from a two-manned kayak or canoe. The PACIFIC ACTION™ sail made in New Zealand is also a V-shaped sail held with twin vertical masts in its vertical orientation with stabilizing cord.

Other conventional sails are described in U.S. Pat. No. 1,859,178 to Sprinkle; U.S. Pat. No. 4,082,049 to April; U.S. Pat. No. 5,289,792 to Forrest et al; U.S. Pat. No. 5,377,607 to Ross; U.S. Pat. No. 6,390,013 to Cornell; U.S. Pat. No. 6,457, 430 to Drabkin; U.S. Pat. No. 6,615,758 to Blad; U.S. Pat. No. 6,655,314 to Housely et al; U.S. Pat. No. 6,776,115 to DeMeo; and U.S. Pat. No. 6,807,919 to Thomsen.

U.S. Patent Publication No. 2009/0139438 to Wiltz describes a sail for propelling watercraft and land vehicles. Wiltz teaches the sail is constructed with a substantially rigid, yet foldable and elastic perimeter batten that supports a flexible sail structure to capture wind energy. The flexible sail structure includes a hollow body defining a substantially hemispherical shape when fully expanded by the captured wind. A perimeter sleeve is provided at a front end of the sail structure for housing the batten. The batten is a single, closed-loop structure made of a resilient material. The sail uses the flexible properties of its batten to both support the wind-harnessing flexible sail structure as well as to compactly fold itself into a geometrical size less than its original deployment size when twisted and coiled upon itself as three contiguous coils.

SUMMARY OF THE INVENTION

At least one embodiment of the present invention includes a paddle-type vessel having a removable and portable sail. The paddle-type vessel may take the form of a kayak while the sail may be easily deployable or stowable by a paddler.

In one aspect of the invention, a sail securable to a small boat, the sail includes a flexible material; a contiguous perimeter member secured around the flexible material to make the flexible material substantially taut before a wind load is applied to the sail; and fastening members extending from the flexible material or the perimeter member, the fastening members being securable to the small boat.

In another aspect of the invention, a manual paddle-type boat includes a deck of the boat having a plurality of structural attachment points; and a sail expandable to be in a deployed configuration and collapsible to be in a stowed configuration. The sail includes a deformable frame; a material membrane coupled to the deformable frame and maintained substantially taut by the frame when in the deployed configuration; and a plurality of attachment devices operable to engage the attachment points of the deck.

In yet another aspect of the invention, a method of deploying a sail for a manual paddle-type boat includes the steps of (1) expanding a deformable frame and a material membrane into a deployed configuration wherein the deformable frame makes a continuous, non-circular loop; (2) attaching at least one clipping device of the sail to a deck of the boat for stabilizing the sail in the deployed configuration relative to the deck; and (3) routing a dousing line from a central, upper portion of the deformable frame, through a guide coupled to a central, lower portion of the deformable frame, and toward a seating area of the boat.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention relates generally to a removable and flexible sail for a paddle-style boat, such as a kayak or canoe. The sail preferably takes the form of a compact and fast deploying down-wind sail attachable to a deck of a kayak. The sail includes a curved, but non-circular shaped flexible material coupled to a collapsible, continuous frame member, for example the frame member may be sewn into a channel made by the flexible material.

When mounted to the deck of the boat the sail may be arranged in a deployed configuration or a stowed configuration, the latter being deployable on the fly in that the sail can be quickly sprung into the deployable configuration. The non-circular shape of the sail cooperates with a hull shape of the boat while providing a sufficient surface area for capturing wind energy. The sail may also include a transparent region that helps to prevent excessive amounts of spray or rain from striking the paddler and yet still providing an adequate viewing range.

Figure 1:
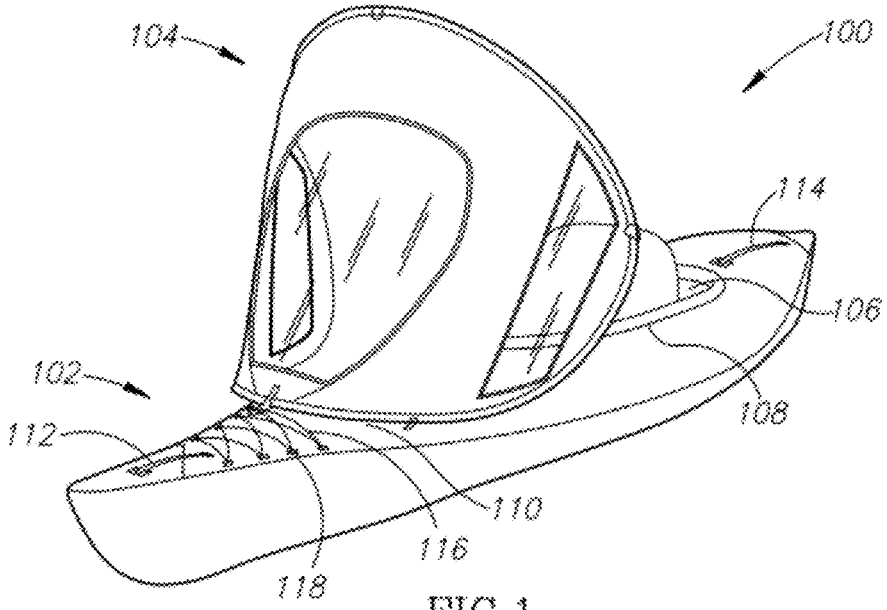
FIG. 1 is a perspective view of a paddle-type boat having a sail according to an embodiment of the present invention.

FIG. 1 shows a paddle-type vessel 100 that includes a kayak-style boat 102 and a sail 104 attached thereto. In the illustrated embodiment, the boat 102 takes the form of a hybrid, inflatable kayak having an outer cover that extends from bow to stern and from port to starboard. A cockpit 106 arranged near a mid section of the kayak includes an inflatable coaming 108 for deflecting water away from the paddler. The outer cover is taut over an internal frame assembly such as rigid poles or inflated bladders and defines a deck 110 in front of the cockpit 106. In one embodiment, the lower portion of the outer cover is made from heavy-duty polyvinyl chloride tarpaulin that provides a desired amount of puncture resistance. The upper portion is constructed of treated nylon. The boat 102 may include fore/aft tote handles 112, 114 for lifting or otherwise maneuvering the boat. The front handle 112 may be utilized for attaching the sail 104. In addition, the boat 102 may include elastic deck lacing 116 and other attached fore/aft webbing or cord 118 (best shown in FIG. 3). In the illustrated embodiment, it is appreciated that the hull shape, cockpit location and other features may be varied depending on an intended purpose of the boat.

Figure 2:
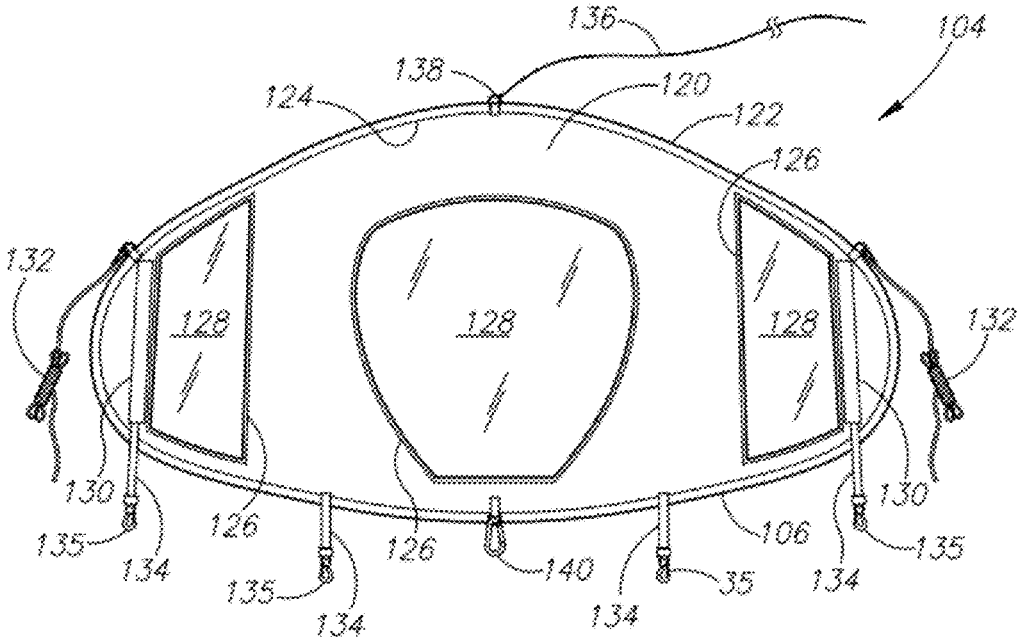
FIG. 2 is a front elevational view of the sail of FIG. 1 in a deployed configuration according to an embodiment of the present invention.

FIG. 2 shows the sail 104 having a material membrane 120 attached to a deformable frame 122. The material membrane 120 may be made from a high quality, durable rip-stop material having a sewn periphery channel 124 configured to receive the frame 122. In the illustrated embodiment, the material membrane 120 includes openings 126 into which transparent panels 128 may be sewn or otherwise attached. When attached to the boat 102 the panels 128 may provide forward and periphery views relative to the cockpit 106 (FIG. 1). By way of example, the panels 128 may include a central window and two side windows for adequate visibility. In an alternate embodiment, the material membrane 120 may be a monolithic fabric in which selected portions are substantially transparent. In one embodiment, the shape of the material membrane 120 may be selected to conform to a kayak deck. The frame 122 may take the form of a non-corroding frame, such as a fiberglass frame, that provides the sail 104 the ability to "spring" open. Further, the frame 122 may take an approximately oval shape when in the deployed configuration.

In the illustrated embodiment, the sail 104 further includes side stabilizing members 130 sewn into the material membrane 120. The side stabilizing members 130 may be made of a non-corroding material, such as fiberglass. Stabilization lanyards 132 are coupled to the stabilizing members 130. The stabilizing members 130 may be oriented generally parallel to an apex intersection axis of the sail. The length of the stabilization lanyards 132 may vary depending on the size or configuration of the boat 102. Deck attachment devices 134 may take the form of fore and aft snap hook assemblies, d-rings or other quick-connect devices 135 with associated webbing for attaching to the material membrane 120. With the upper ends of battens or stabilizing members 130 secured with lanyards 132 and the lower ends pressing against the upper deck of the boat the sail 104 becomes stabile and well supported in the wind. Extra securement can be made with deck attachment devices 134. Having the stabilizing members 130 within the sail and secured in this manner allows the user to significantly tension the lanyards 132 without collapsing the sail, even though the perimeter is formed with the flexible frame 122.

A dousing cord or line 136 is attached to an upper, central portion 138 of the frame 122 and has a length sufficient to be routed from the portion 138, along a front, exterior surface of the sail 104, through a guide member 140, and then accessible by the paddler in the cockpit 106 (FIG. 1). The guide member 140 may take the form of a non-locking or locking carabiner. The arrangement of the dousing line 136 and guide member 140 permits the paddler to quickly pull on the dousing line to "dump" air from the sail 104 during an unwanted wind speed or wind direction condition. Wind is released from the sail when the dousing cord 136 is pulled by elastically deforming the flexible frame between the stabilizing members 130. Release of the tension on the dousing cord 130 will allow the sail to resume its curved ovalized shape to again catch the wind.

Figure 3:
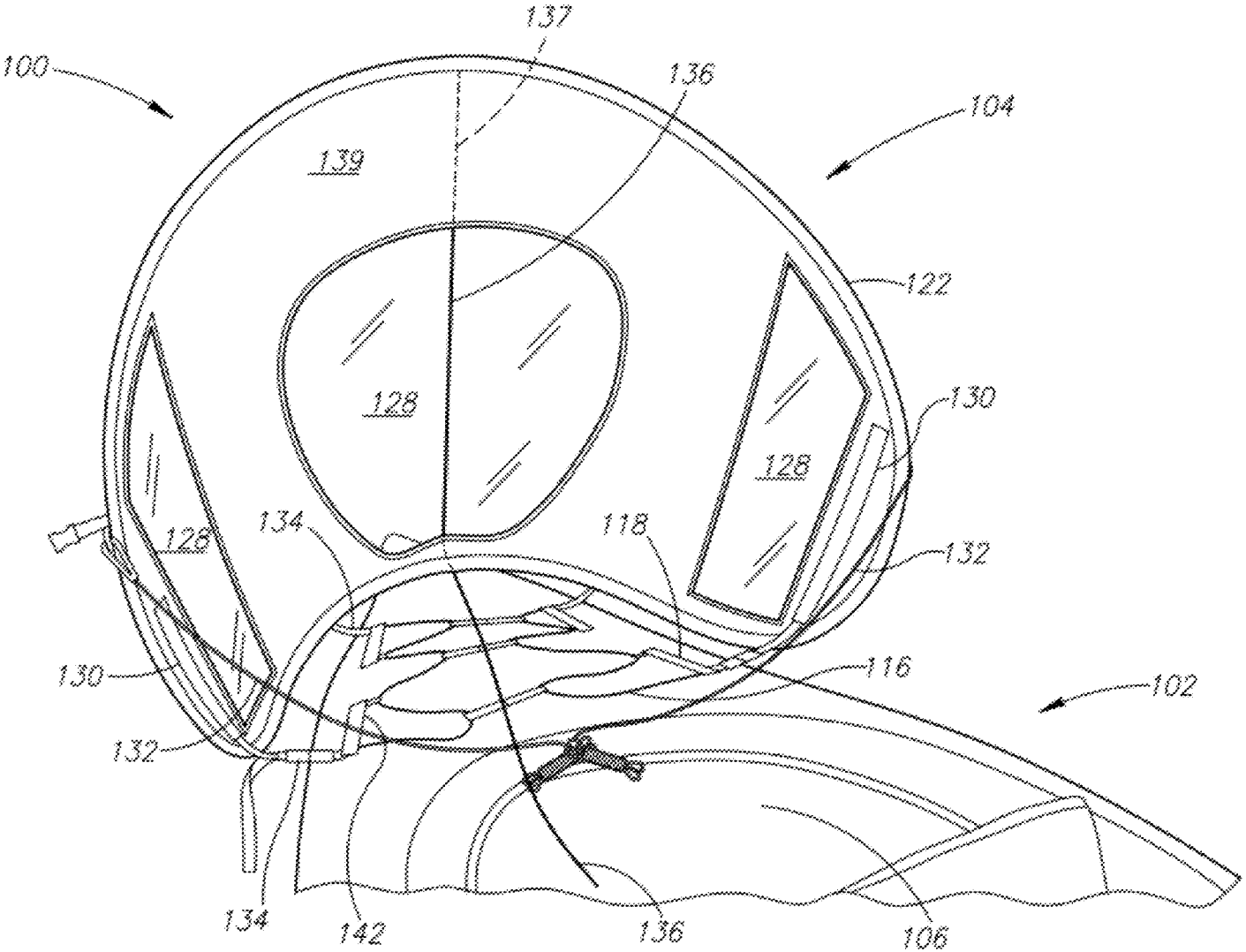
FIG. 3 a rear elevational view of the sail of FIG. 1 in a deployed configuration according to an embodiment of the present invention.

FIG. 3 shows the paddle-type vessel 100 with the sail 104 attached to the boat 102. The sail 104 is shown in the deployed configuration with the dousing line 136 extending from the upper, central portion 138 into the cockpit 106. An apex intersection line or axis 137, which may approximate the position of the dousing line 136, extends parallel to a surface 139 of the sail and approximately normal to the deck of the boat. The attachment devices 134 are coupled to the deck lacing 116 or may be attached to other boat structure such as, but not limited to, other lacing, webbing 118 (having eyelets for the lacing 116), bosses, gussets, clips, eyelets, etc. The stabilization lanyards 132 are tied, lashed or otherwise attached to a portion of the cockpit 106 or seat buckles (not shown).

Figure 4A:
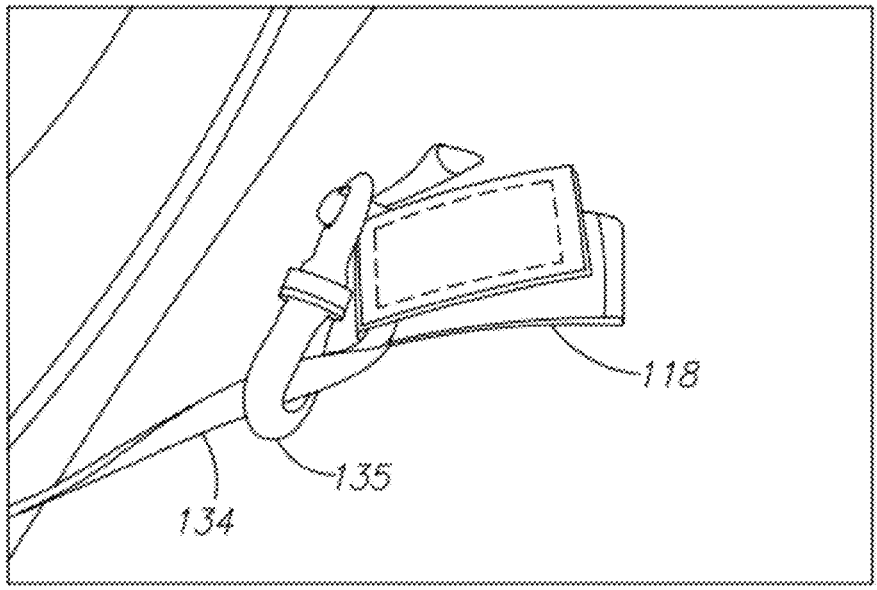
FIG. 4A is a detail view of an attachment device of the sail coupled to the boat according to an embodiment of the present invention.
Figure 4B:
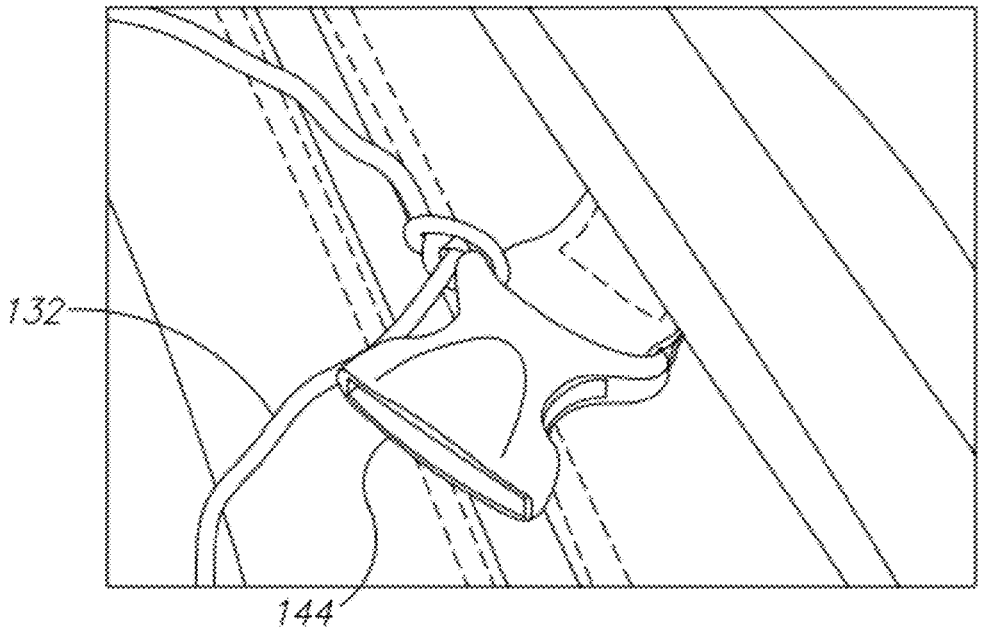
FIG. 4B is a detailed view of a stabilization line of the sail coupled to the boat according to an embodiment of the present invention.

By way of example, FIG. 4A shows a close-up view of one of the attachment devices 134 clipped to the deck webbing 118. FIG. 4B shows a close-up view of the stabilization lanyard 132 tied to a seat buckle 144.

Figure 5:
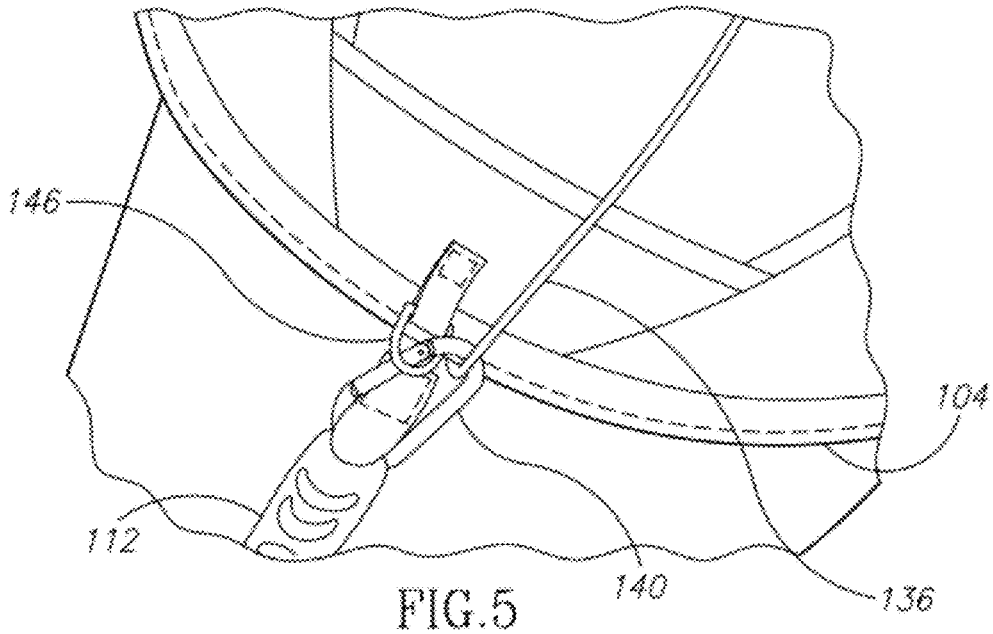
FIG. 5 is detail view of a guide member and dousing line of the sail coupled to the boat according to an embodiment of the present invention.

FIG. 5 shows the guide member 140 coupled to a D-ring 146, which is attached to the sail 104. Further, the guide member 140 is clipped to the front handle 112 and configured to route the dousing line 136 toward the cockpit 106 (FIG. 1).

The bottom portion of the sail is anchored to the deck while a top portion is anchored with a string. Thus, the taut and curved sail may be secured in the deployed configuration without collapsing. Because the sail is taut with generally an oval shape it becomes curved about a vertical axis when in the deployed configuration. The vertical axis may be approximated as an axis parallel to an imaginary line that extends normal to the deck. Thus, the deployed configuration permits the sail to be wind loaded while providing for triangular or arcuate attachment points relative to the deck. Stated otherwise, the portion of the sail proximate the deck may form a parabolic shaped curve or may approximate a triangle. This configuration advantageously makes it easier for the sail to be wind loaded and remain sufficiently stable.

Figure 6A:
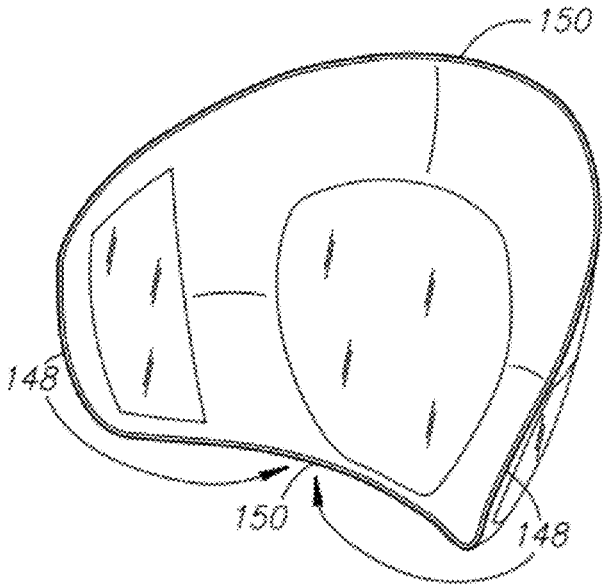
FIGS. 6A-6C are diagrams that schematically show a folding process for converting the sail from a deployed configuration to a stowed configuration according to an embodiment of the present invention.
Figure 6B:
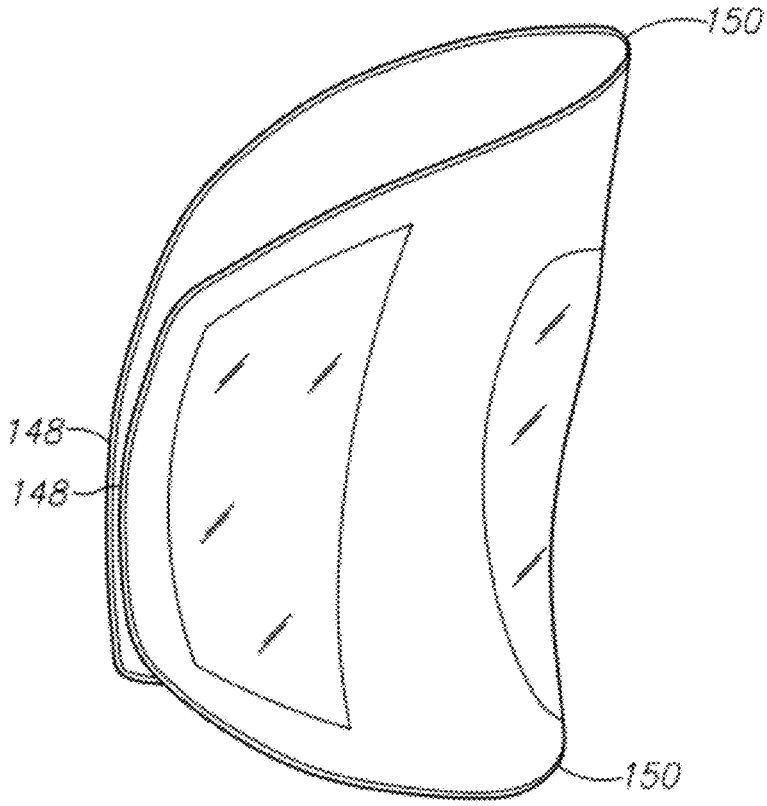
Figure 6C:
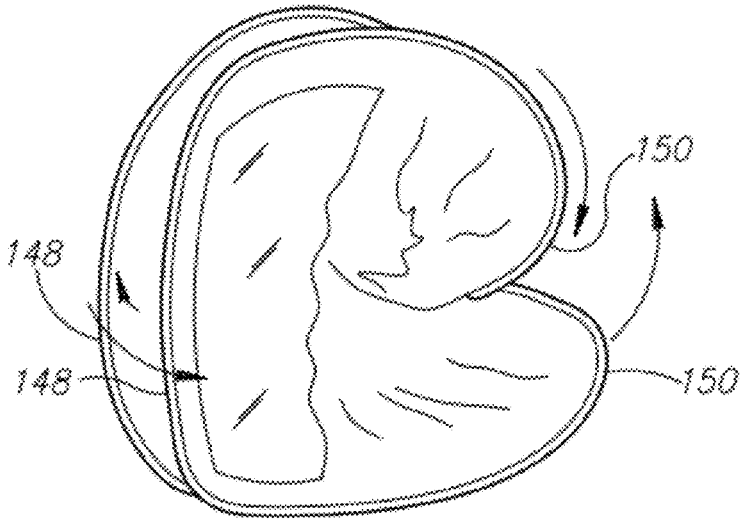

FIGS. 6A-6C shows a process of folding the sail 104 into its stowed configuration. For descriptive purposes, the sail 104 includes left/right sides 148 and top/bottom sides 150. Starting with the sail 104 in its deployed configuration, a first step in the folding process includes bringing the sides 148 together and then holding them together with one hand (FIGS. 6A and 6B). As best shown in FIG. 6C, a free hand (not shown) urges the top side 150 toward the bottom side 150, which initiates an overlapping and coiling process of the frame 122 (FIG. 2).

Figure 7:
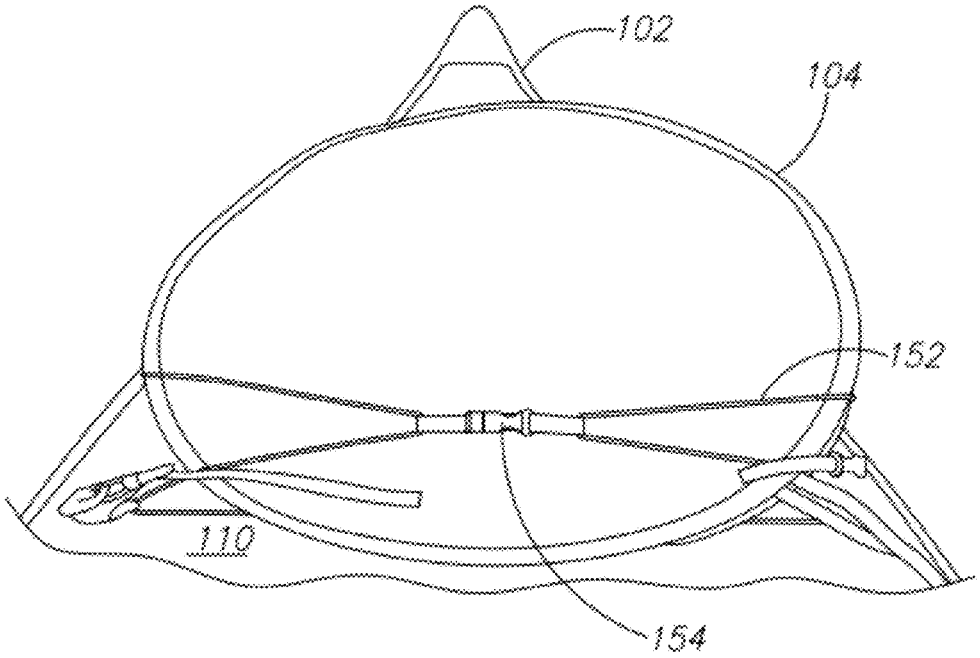
FIG. 7 is a perspective view of the sail of FIG. 2 being maintained in the stowed configuration on the boat with a bungee cord assembly according to an embodiment of the present invention.

With the sail 104 in the stowed configuration as shown in FIG. 7, the sail 104 may be secured to the deck 110 of the boat 102. In the illustrated embodiment, a bungee cord assembly 152 making up the deck lacing 116, includes a quick-release clip 154 (FIG. 3). Other deck structure may alternatively be used to hold the folded sail. The folded sail may be placed within its storage bag before securement to the deck or the deck lacing may hold the sail in its folded configuration on the deck. The other attachment components discussed above operate to secure the sail 104 to the deck so it does not get blown or washed off.

Figure 8:
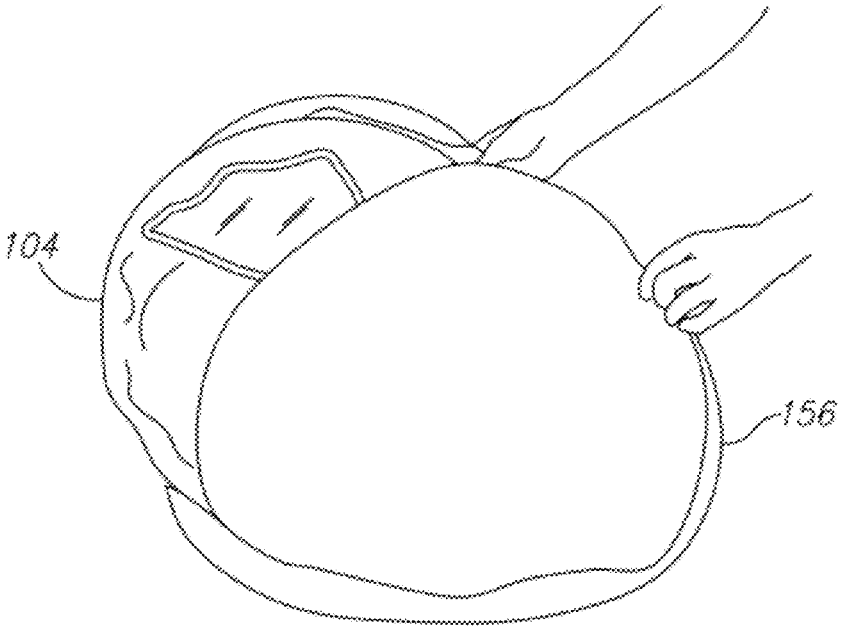
FIG. 8 is a perspective view of the sail of FIG. 2 in the stowed configuration and being placed into a storage bag according to an embodiment of the present invention.

FIG. 8 shows the sail 104 folded flat into its stowed configuration and storable into a portable bag 156. In the illustrated embodiment, the portable bag 156 takes a circular shape, but may take other shapes. Further, the bag 156 may include attachment devices to couple the bag to the boat.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property or privilege is claimed are defined as follows:

1. A sail securable to a small boat, the sail comprising:
a membrane;
a perimeter member secured around a perimeter of the membrane to make the membrane substantially taut before a wind load is applied to the sail;
fastening members extending from the membrane or the perimeter member, the fastening members being securable to the small boat; and
stabilizing members secured to the membrane and extending across the membrane having upper and lower ends thereof structurally coupled to the perimeter member, the stabilizing members configured to resist collapse of the perimeter member;
wherein the stabilizing members each comprise an elongate batten secured within the membrane.

2. The sail of claim 1, wherein the perimeter member is bendable to be arranged into at least two loops for storage.

3. The sail of claim 1, wherein a shape of the sail is approximately oval when in a deployed configuration.

4. The sail of claim 1, wherein the stabilizing members are secured to the membrane generally parallel to an apex intersection axis of the sail when in a deployed configuration.

5. The sail of claim 1, wherein the fastening members are attached to the perimeter member adjacent upper ends of the stabilizing members.

6. The sail of claim 1, further comprising a dousing line secured at an apex of the sail extending approximately parallel to an apex intersection axis of the sail when in a deployed configuration, the dousing line passing through a member secured at a bottom of the sail.

7. The sail of claim 1, further comprising at least one side window formed in the membrane.

8. The sail of claim 1, wherein a portion of the sail proximate a deck of the boat forms approximately a parabolic curve when in the deployed configuration and secured to the boat.

9. The sail of claim 1, wherein the perimeter member and membrane are bent about a vertical axis in a deployed configuration.

10. A sail securable to a small boat, the sail comprising:
a membrane;
a perimeter member secured around a perimeter of the membrane to make the membrane substantially taut before a wind load is applied to the sail;
fastening members extending from the membrane or the perimeter member, the fastening members being securable to the small boat; and
a dousing line secured to the perimeter member at an apex of the sail extending approximately parallel to an apex intersection axis of the sail when in a deployed configuration, the dousing line passing slidingly through a member located at a bottom of the sail and secured to the perimeter member at the bottom of the sail.

11. The sail of claim 10, wherein the dousing line extends over a front surface of the sail when in a deployed configuration.

12. The sail of claim 10, further comprising elongate stabilizing members secured along entire lengths thereof to the membrane generally parallel to an apex intersection axis of the sail when in a deployed configuration, the elongate stabilizing members each comprising a non-corroding material.

13. The sail of claim 10, wherein the non-corroding material is fiberglass.

14. A sail securable to a small boat, the sail comprising:
a membrane;
a perimeter member secured around a perimeter of the membrane to make the membrane substantially taut before a wind load is applied to the sail;
fastening members extending from the membrane or the perimeter member, the fastening members being securable to the small boat; and
stabilizing members secured to the membrane and extending across the membrane having upper and lower ends thereof structurally coupled to the perimeter member, the stabilizing members configured to urge the perimeter member outwardly from the membrane;

wherein the stabilizing members are secured within the membrane and each stabilizing member comprises an elongate non-corroding member.

15. The sail of claim 14, wherein the non-corroding material is fiberglass.

16. The sail of claim 14, wherein the elongate non-corroding member is sewn into the membrane.

* * * * *